US008139094B2

(12) United States Patent
Koyama et al.

(10) Patent No.: US 8,139,094 B2
(45) Date of Patent: Mar. 20, 2012

(54) THERMAL HEAD AND THERMAL PRINTER

(75) Inventors: Noboru Koyama, Tokyo (JP); Mitsuo Yanase, Kanagawa (JP); Toru Morikawa, Kanagawa (JP); Kei Sato, Miyagi (JP)

(73) Assignee: Sony Corporation, Tokyo (JP)

( * ) Notice: Subject to any disclaimer, the term of this patent is extended or adjusted under 35 U.S.C. 154(b) by 255 days.

(21) Appl. No.: 12/320,550

(22) Filed: Jan. 29, 2009

(65) Prior Publication Data

US 2009/0195632 A1 Aug. 6, 2009

(30) Foreign Application Priority Data

Feb. 1, 2008 (JP) ..... 2008-022965

(51) Int. Cl.
*B41J 2/34* (2006.01)

(52) U.S. Cl. ..... 347/200; 347/205

(58) Field of Classification Search ..... 347/205
See application file for complete search history.

(56) References Cited

U.S. PATENT DOCUMENTS

2002/0145658 A1* 10/2002 Shirakawa et al. ..... 347/203
2007/0257980 A1 11/2007 Koyama et al.

FOREIGN PATENT DOCUMENTS

JP 2007-245675 9/2007

* cited by examiner

*Primary Examiner* — Uyen Chau N Le
*Assistant Examiner* — Hoang Tran
(74) *Attorney, Agent, or Firm* — Rader, Fishman & Grauer PLLC

(57) ABSTRACT

A thermal head which forms an image on a recording medium by pressing a protruding portion on which heating elements are arranged on the recording medium while driving the heating elements to be heated includes a head body portion in which the protruding portion and a concave gap portion facing the protruding portion are formed and a heat conductive layer provided on the side of the protruding portion of the head body portion, in which the heat conductive layer includes an electric insulating layer securing electric insulation to the heating elements and a heat diffusion layer diffusing heat generated from the heating elements.

2 Claims, 9 Drawing Sheets

THERMAL HEAD AND THERMAL PRINTER

CROSS REFERENCE TO RELATED APPLICATIONS

The present invention contains subject matter related to Japanese Patent Application JP 2008-022965 filed in the Japanese Patent Office on Feb. 1, 2008, the entire contents of which being incorporated herein by reference.

BACKGROUND OF THE INVENTION

1. Field of the Invention

The invention relates to a thermal head and a thermal printer which form an image on a recording medium by pressing a protruding portion on which heating elements are arranged on the recording medium while driving heating elements to be heated. Particularly, the invention relates to a technique for improving heat resistance and breaking strength of the thermal head.

2. Description of the Related Art

A thermal printer including a thermal head having heating resistive elements (heating elements) arranged on a protruding portion and a platen roller provided so as to face the thermal head is conventionally known. Such a thermal printer forms an image by pressing the protruding portion of the thermal head on the printing paper (recording medium) carried on the platen roller. The protruding portion and the printing paper are pressed by moving the thermal head or the platen roller.

The thermal printer has a sublimation method, a heat sensitive method and the like as an image forming method. In any method, power is selectively applied to the heating resistive elements of the thermal head according to the tone level, and the image is formed by using thermal energy generated at that time. For example, in the case of a sublimation-type thermal printer, when the protruding portion of the thermal head is pressed on the printing paper through an ink ribbon and the heating resistive elements are driven to be heated, ink on the ink ribbon is sublimed on the printing paper in proportion to thermal energy of the heating resistive elements to perform printing.

As described above, the thermal head heats the heating resistive elements for performing printing, and most of the heat generated from the heating resistive elements at the time of printing is transmitted in the opposite direction of the printing paper and released. Therefore, in order to print at high speed, it is necessary to heat the heating resistive elements at high temperature immediately, however, there arises a problem that power consumption increases. Since it is necessary to increase a printing speed while saving power particularly in a thermal printer for home use, it is desirable to improve thermal efficiency of the thermal head to reduce power consumption.

A technique of improving thermal efficiency and response of the thermal head in order to reduce power consumption of the thermal printer as well as to print high quality images or characters at high speed is known. Specifically, in the technique, a gap portion is formed in a glass substrate in which heating resistive elements are arranged, and an air layer in the gap portion makes heat generated from the heating resistive elements difficult to be released in the direction of the glass substrate to improve thermal efficiency as well as the gap portion reduces the heat accumulation amount of the glass substrate to improve response (For example, refer to JP-A-2007-245675 (Patent Document 1)).

FIG. 9 is a longitudinal sectional view showing a thermal head 110 in related art, which is disclosed in the Patent Document 1.

As shown in FIG. 9, in the thermal head 110, a heating resistive element 112, a power supply electrode 113*a* and a drive electrode 113*b* for heating the heating resistive element 112 and a protective film 114 for protecting the heating resistive element 112, the power supply electrode 113*a* and the drive electrode 113*b* are sequentially stacked on a glass substrate 111 to form a head body portion, on which a protruding portion 111*a* having an approximately arc-shape in vertical section is formed. A portion between the power supply electrode 113*a* and the drive electrode 113*b*, in which the heating resistive element 112 is exposed, is a heating portion 112*a* which actually generates thermal energy.

The heating portion 112*a* having a rectangular shape of a length L1 is provided on the protruding portion 111*a* so that the heating portion 112*a* can be pressed on the ink ribbon and the printing paper. In the glass substrate 111 on which the protruding portion 111*a* is formed, a concave gap portion 111*b* having a width W2 which faces the protruding portion 111*a* is also formed. The width W2 of the gap portion 111*b* is formed to be larger than the length L1 of the heating portion 112*a* (gap portion width W2>heating portion length L1) and the gap portion 111*b* is filled with air. Furthermore, a heatsink 115 adheres to the bottom of the glass substrate 111 by an adhesive 116 so as to close an opening surface of the gap portion 111*b*.

In the above thermal head 110, thermal conductivity in the gap portion 111*b* is low due to characteristics of air having lower thermal conductivity than glass forming the glass substrate 111. That is, since the width W2 of the gap portion 111*b* is larger (gap portion width W2>heating portion length L1), the amount of air in the gap portion 111*b* becomes large, and heat release from the heating portion 112*a* provided on the protruding portion 111*a* of the glass substrate 111 to the direction of the glass substrate 111 is suppressed. Therefore, thermal energy transmitted in the direction of the ink ribbon pressed by the protruding portion 111*a* is increased. As a result, power consumption which is necessary for increasing a temperature of ink on the ink ribbon to the sublimation temperature of the ink is reduced, which improve thermal efficiency of the thermal head 110.

Additionally, the thickness of the protruding portion 111*a* of the glass substrate 111 is reduced by the gap portion 111*b* and the heat accumulation amount of the glass substrate 111 is reduced, therefore, thermal energy accumulated in the glass substrate 111 can be released in a short time. As a result, when ink on the ink ribbon is not sublimed (when the heating portion 112*a* is not heated), the temperature of the heating portion 112*a* decreases immediately, which improves response of the thermal head 110.

SUMMARY OF THE INVENTION

However, it is demanded that power consumption is further reduced and printing is performed at high speed even in the thermal head 110 shown in FIG. 9. In order to realize the above, it is necessary not only to further improve thermal efficiency and response but also to take countermeasures for durability and reliability of the heating portion 112*a* of the thermal head 110 temperature of which increases. It is also necessary to improve heat resistance and breaking strength of the protruding portion 111*a* which will be exposed to high temperature just under the heating portion 112*a*.

Accordingly, it is desirable to secure durability and reliability of heating elements by reducing extreme temperature increase of the heating portions as well as improve heat resistance, breaking strength of the protruding portion of the head body portion on which the heating elements are arranged to obtain good thermal efficiency and response to thereby reduce power consumption and to realize high-speed printing.

According to an embodiment of the invention, there is provided a thermal head which forms an image on a recording medium by pressing a protruding portion on which heating elements are arranged on the recording medium while driving the heating elements to be heated, including a head body portion in which the protruding portion and a concave gap portion facing the protruding portion are formed and a heat conductive layer provided at the side of the protruding portion of the head body portion, in which the heat conductive layer has an electric insulating layer securing electric insulation to the heating elements and a heat diffusion layer diffusing heat generated from the heating elements.

According to an embodiment of the invention, there is provided a thermal printer including a thermal head which forms an image on a recording medium by pressing a protruding portion on which heating elements are arranged on the recording medium while driving the heating elements to be heated, in which the thermal head has a head body portion in which the protruding portion and a concave gap portion facing the protruding portion are formed, and a heat conductive layer provided on the side of the protruding portion of the head body portion, in which the heat conductive layer has an electric insulating layer securing electric insulation to the heating elements and a heat diffusion layer diffusing heat generated from the heating elements.

(Operation)

According to an embodiment of the invention, the heat conductive layer provided on the side of the protruding portion of the head body portion is included. The heat conductive layer has the electric insulating layer securing electric insulation to the heating elements and the heat diffusion layer diffusing heat generated from the heating elements. Accordingly, the heat distribution concentrated on the heating portions of the heating elements is diffused by the heat diffusion layer and extreme temperature increase of the heating portions is reduced.

According to an embodiment of the invention, the heat distribution concentrated on the heating portions is diffused and extreme temperature increase of the heating portions is reduced, therefore, durability and reliability of the heating portions are improved. Additionally, heat resistance and breaking strength of the protruding portion of the head body portion on which the heating elements are arranged are improved. Accordingly, good thermal efficiency and response can be obtained. As a result, not only power consumption can be reduced but also high-speed printing can be performed.

DESCRIPTION OF THE PREFERRED EMBODIMENTS

Hereinafter, embodiments of the invention will be explained with reference to the drawings.

Figure 1:
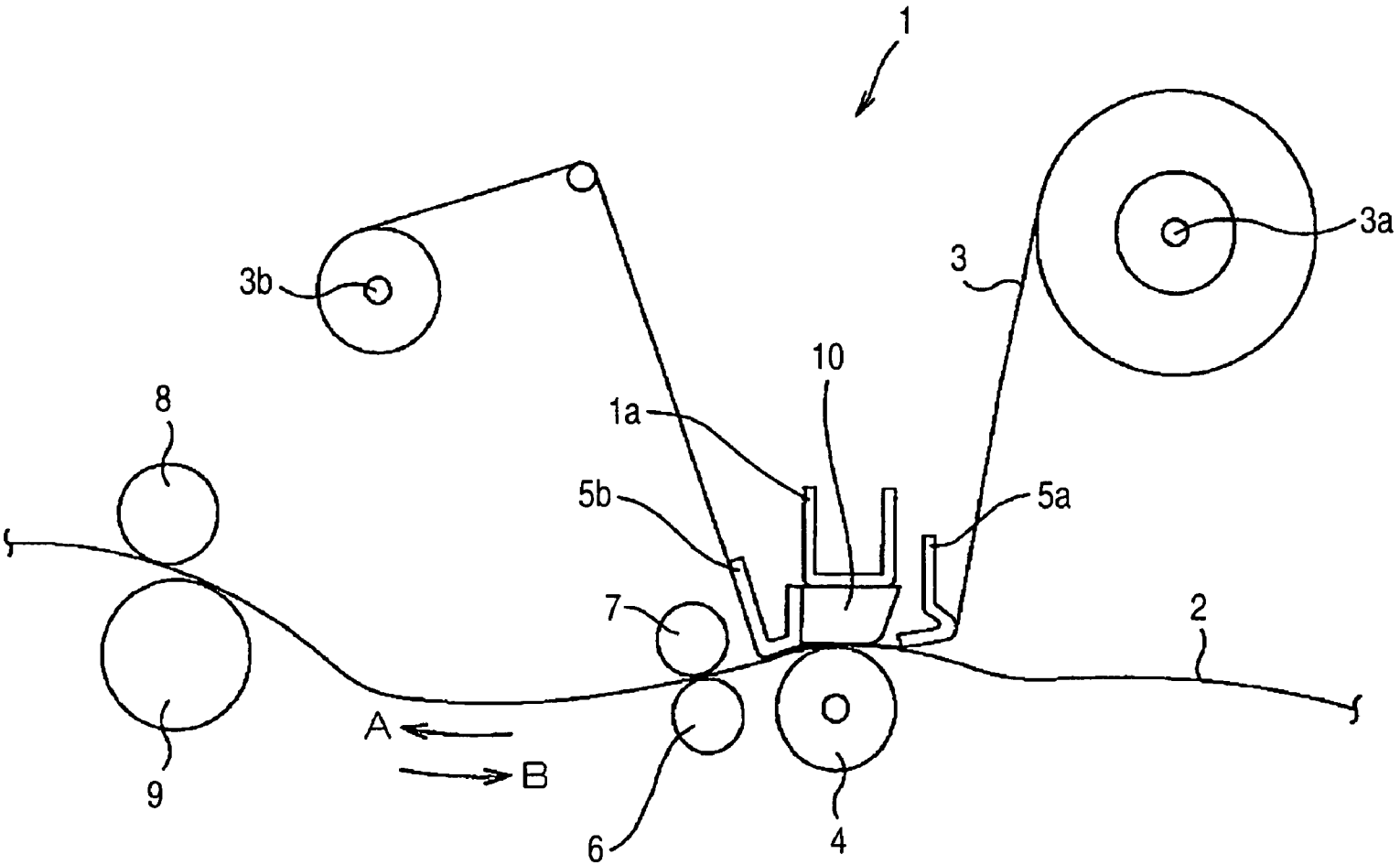
FIG. 1 is a side view of an outline showing a thermal printer including a thermal head according to a first embodiment.

FIG. 1 is a side view of an outline showing a thermal printer 1 including a thermal head 10 according to a first embodiment.

Figure 2:
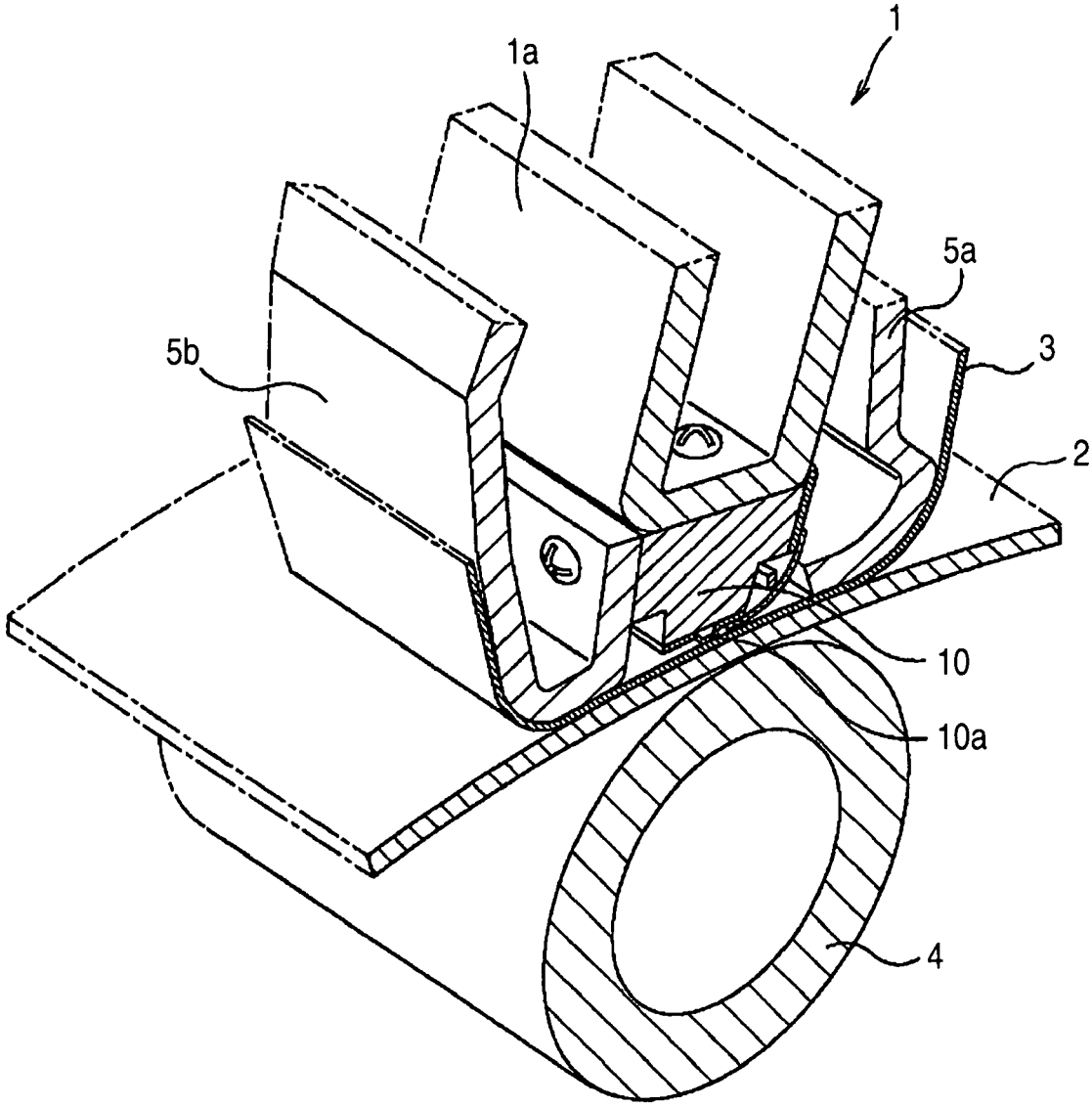
FIG. 2 is a perspective view showing the periphery of the thermal head according to the first embodiment.

FIG. 2 is a perspective view showing the periphery of the thermal head 10 according to the first embodiment.

As shown in FIG. 1 and FIG. 2, the thermal printer 1 is a sublimation type printer which forms an image on a printing paper 2 (recording medium) by subliming ink on an ink ribbon 3. Specifically, the thermal printer 1 prints color images or characters on the printing paper 2 by subliming ink on the ink ribbon 3 by thermal energy generated by the thermal head 10.

The thermal printer 1 includes the thermal head 10, a platen roller 4 provided at a position facing the thermal head 10, ribbon guides 5*a*, 5*b* which guide running of the ink ribbon 3, a capstan roller 6 which carries the printing paper 2 pressed between the thermal head 10 and the platen roller 4, a pinch roller 7 which driven-rotates, facing the capstan roller 6, a delivery roller 8 which delivers the printing paper 2 after printing and a carrying roller 9 which carries the printing paper 2 in the opposite direction, namely, toward the thermal head 10. The thermal head 10 is attached to a fixing member 1*a* in a casing side of the thermal printer 1.

Here, the ink ribbon 3 is formed by a long resin film, which is housed in an ink cartridge in a state of being wound between a supply spool 3*a* and a winding spool 3*b* as shown in FIG. 1. On one surface of the resin film, three inks of Y (yellow), M (magenta) and C (cyan), and laminate ink for improving storage stability of the printed images or characters are coated repeatedly. The ribbon guide 3 is guided between the thermal head 10 and the platen roller 4 by the ribbon guides 5*a*, 5*b* provided in the supplying side and the winding side of the ink ribbon 3 with respect to the thermal head 10.

In order to perform printing by the above thermal printer 1, the printing paper 2 and the ink ribbon 3 are pressed between a head portion 10*a* of the thermal head 10 and a platen roller 4 as shown in FIG. 2. Then, the winding spool 3*b* shown in FIG. 1 is rotated to allow the ink ribbon 3 to run in the winding direction (left direction in FIG. 1). Further, the printing roller 2 sandwiched between the capstan roller 6 and the pinch roller 7 in the delivery direction (direction of an arrow A in FIG. 1) by rotating the capstan roller 6 and the delivery roller 8. When thermal energy is added to the ink ribbon 3 from the thermal head 10 in this state, ink of Y (yellow) overlapping the printing paper 2 is sublimed and transferred on the printing paper 2.

Next, ink of M (magenta) is transferred on an image forming portion on the printing paper 2 on which ink of Y (yellow) is transferred. For the transfer, the carrying roller 9 is rotated to carry the printing paper 2 backward in the direction of the thermal head 10 (direction of an arrow B in FIG. 1) so as to be returned to a position where a starting edge of image formation on the printing paper 2 faces the thermal head 10. Further, ink of M (magenta) of the ink ribbon 3 is made to face the thermal head 10. Then, in the same manner when the ink of Y (yellow) is transferred, thermal energy is added to the ink ribbon 3 from the thermal head 10 while carrying the printing paper 2 in the delivery direction (direction of the arrow A in FIG. 1), subliming ink of M (magenta) to be transferred on the printing paper 2. Further, in the same manner when the ink of M (magenta) is transferred, ink of C (Cyan) and laminate ink are sequentially transferred on the printing paper 2 to print color images and characters as well as to improve the storage stability of images and the like, then, the printing paper 2 is delivered by the delivery roller 8.

Figure 3:
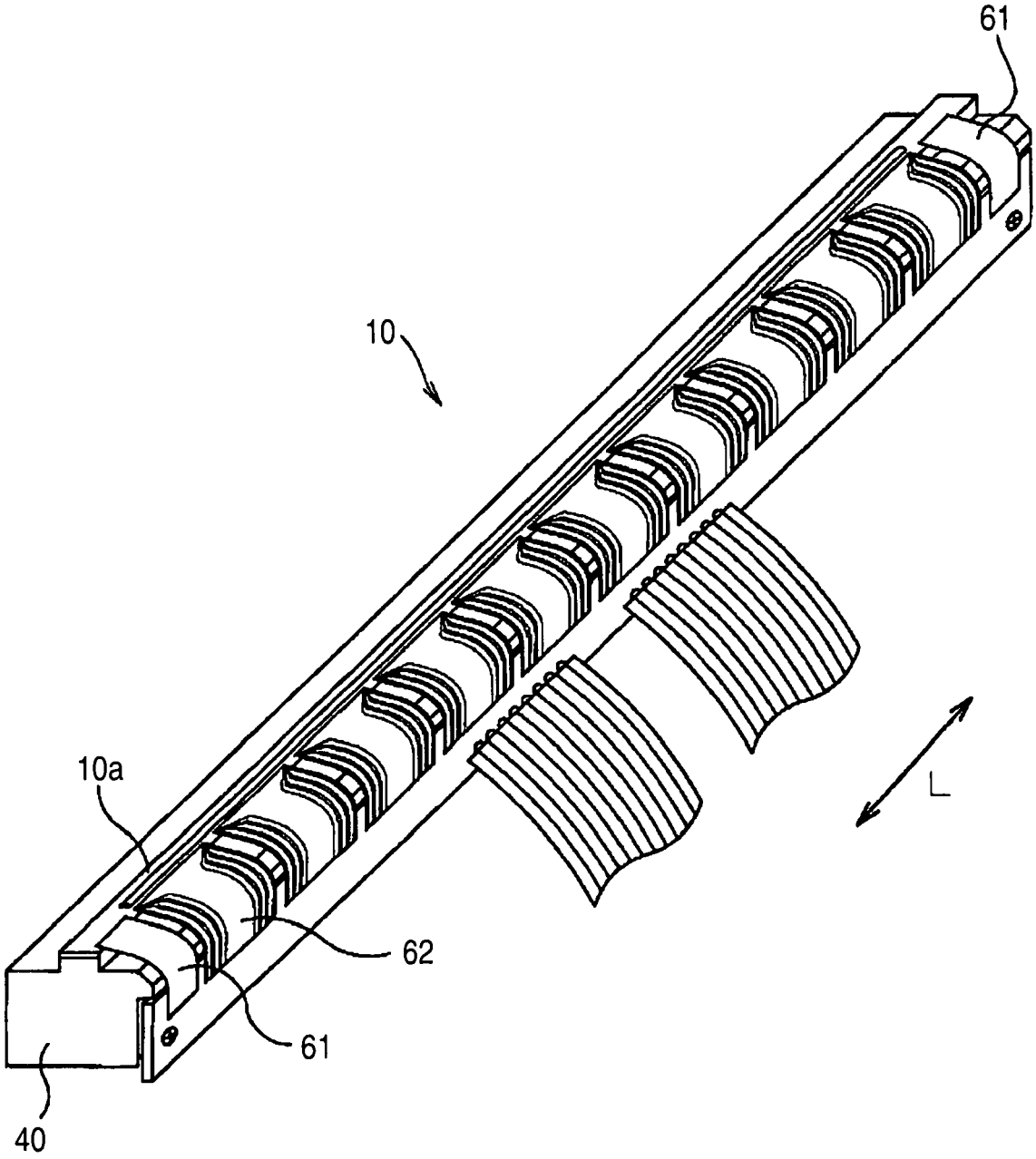
FIG. 3 is a perspective view showing the whole thermal head according to the first embodiment.

FIG. 3 is a perspective view showing the whole thermal head 10 according to the first embodiment.

Figure 4:
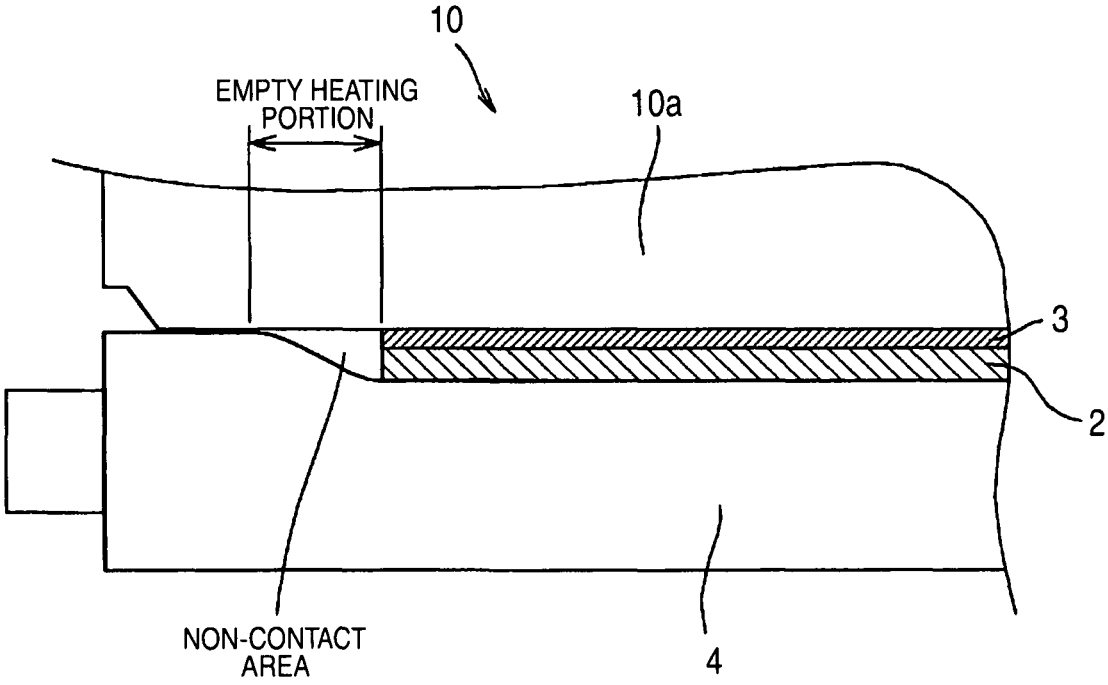
FIG. 4 is a front view showing a state in which a printing paper and an ink ribbon are pressed between the thermal head according to the first embodiment and the platen roller.

FIG. 4 is a front view showing a state in which the printing paper 2 and the ink ribbon 3 are pressed between the thermal head 10 according to the first embodiment and the platen roller 4.

As shown in FIG. 3, in the thermal head 10, a heatsink 40 as a member of releasing generated heat is adhered to the head portion 10*a* which generates thermal energy. That is, excess heat of the head portion 10*a* is released to the heatsink 40 when the printing is not performed. An adhesive 50 (not shown) for the heatsink 40 includes a filler and the like having thermal conductivity.

In order to form an image by the thermal head 10, flexible substrates for power supply 61 in which one end is electrically connected to the head portion 10*a* and the other end is connected to the power supply are provided at both ends of the head portion 10*a*. Furthermore, plural flexible substrates for driving 62 in which one end is electrically connected to the head portion 10*a* and the other end is electrically connected to a control circuit are arranged between the flexible substrates for power supply 61 at both ends of the head portion 10*a*. The flexible substrates for power supply 61 and the flexible substrates for driving 62 are connected interposing a film made of an insulating resin material including conductive particles (for example, ACF: anisotropic conductive film) between these substrates and the head portion 10*a*.

The head portion 10*a* has the width wider than the width of the printing paper 2 in a direction (direction of an arrow L in FIG. 3) orthogonal to the carrying direction of the printing paper 2 (refer to FIG. 4). Therefore, an image with no margin in which there is no blank space at both ends of the printing paper 2 in the width direction can be formed.

However, when the head portion 10*a* has the width wider than the width of the printing paper 2, a non-contact area is generated at an end of the head portion 10*a*, in which the end of the head portion 10*a* does not touch any of the printing paper 2, the ink ribbon 3 and the platen roller 4.

In this the non-contact area, thermal energy of the head portion 10*a* is not transmitted to the ink ribbon 3 and the like, and the area will be an empty heating portion of the head portion 10*a* in which heat release is difficult due to airspace of the non-contact area. Accordingly, temperature in the head portion 10*a* is locally increased at the empty heating portion. Particularly, the temperature at the head portion 10*a* is high by increasing power consumption in recent years when high-speed printing is demanded, therefore, the temperature increase at the empty heating portion also tends to be strong. Then, the heat-resistant temperature of the head portion 10*a* exceeds and a fear of causing destruction occurs, which incurs problems of durability and reliability of the head portion 10*a*. The non-contact area shown in FIG. 4 is also generated by interfusion of foreign materials under the head portion 10*a* during printing and the like, not only at the end portion of the head portion 10*a*.

Accordingly, the heat resistance of the head portion 10*a* is improved, thereby improving the limit of breaking strength due to the local high temperature (temperature increase at the empty heating portion) of the head portion 10*a* as well as improving the durability and reliability. Additionally, thermal efficiency is improved by allowing heat generated from the head portion 10*a* to be not easily released as well as the response is improved by reducing the heat accumulation amount of the head portion 10*a* to realize the thermal head 10 which is capable of performing printing at high speed while saving power.

Figure 5:
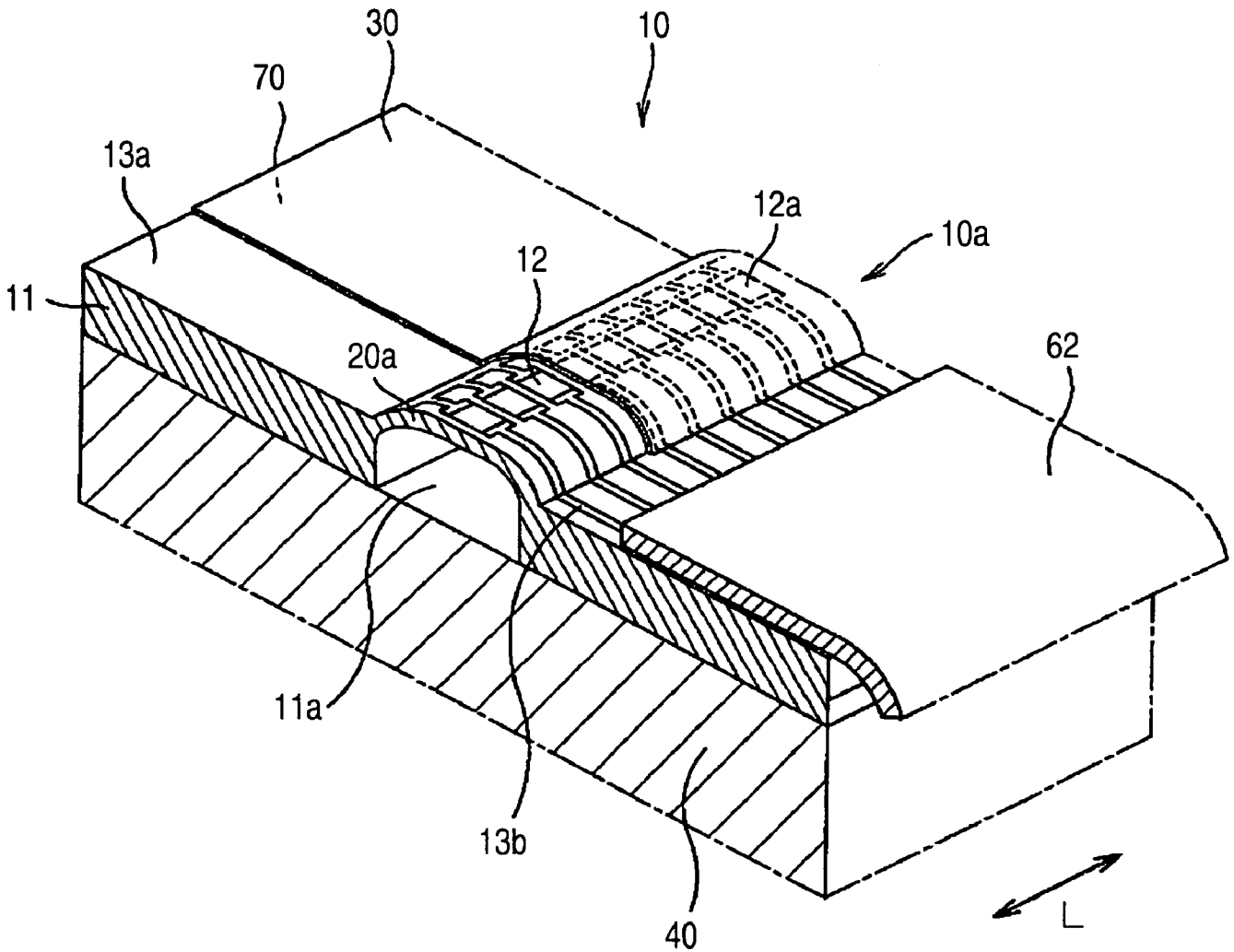
FIG. 5 is a perspective view partially showing the thermal head according to the first embodiment.

FIG. 5 is a perspective view partially showing the thermal head 10 according to the first embodiment.

Figure 6:
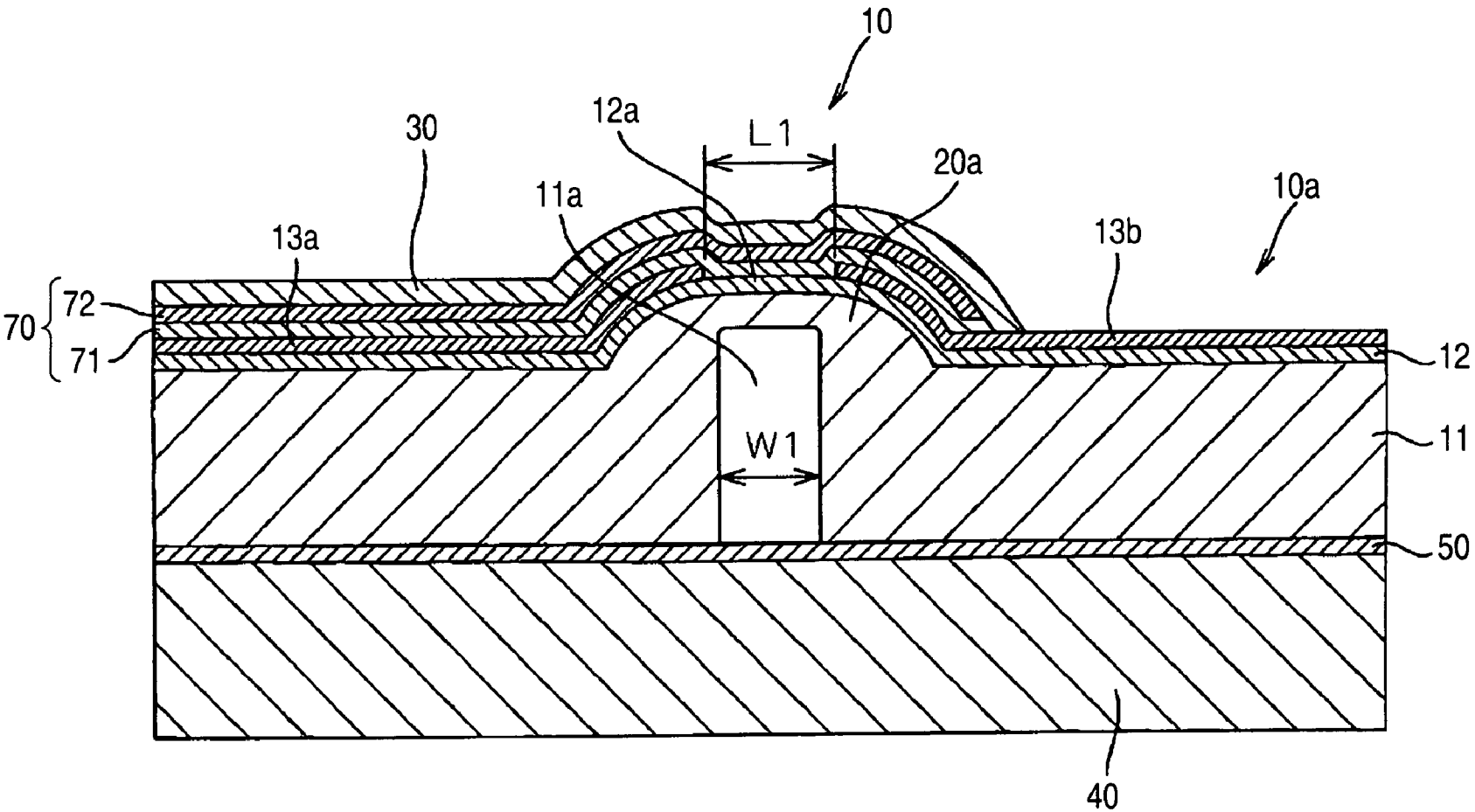
FIG. 6 is a longitudinal sectional view showing the thermal head according to the first embodiment.

FIG. 6 is a longitudinal sectional view showing the thermal head 10 according to the first embodiment.

As shown in FIG. 5 and FIG. 6, the head portion 10*a* of the thermal head 10 includes a glass substrate 11 (which corresponds to a head body portion according to an embodiment of the invention), heating resistive elements 12 (which correspond to heating elements according to an embodiment of the invention) arranged on the glass substrate 11, a power supply electrode 13*a* and drive electrodes 13*b* for heating the heating resistive elements 12, a heat conductive layer 70 provided over the heating resistive elements 12, the power supply electrode 13*a* and the drive electrodes 13*b*, and a protective film 30 provided on the heat conductive layer 70.

In the head portion 10*a*, the flexible substrates for power supply 61 are electrically connected to the power supply electrode 13*a* through the ACF (anisotropic conductive film) for generating thermal energy from the heating resistive elements 12. Also, flexible substrates for driving 62 (refer to FIG. 5) are electrically connected to the drive electrodes 13*b* through the ACF (anisotropic conductive film).

The glass substrate 11 is a main body of the head portion 10*a*, for example, formed to be a rectangle by glass having a softening point of approximately 500° C. and a rate of thermal conductivity of approximately 1 W/mK. In the glass substrate 11, a concave gap portion 11*a* having the width W1 is formed. The glass substrate 11 is made of a material having prescribed surface property, thermal characteristics and the like as represented by glass, however, the head body portion according to an embodiment of the invention is not limited to the glass substrate 11, and it is preferable to apply support substrates made of synthetic jewels such as artificial crystal, artificial ruby and artificial sapphire, an artificial stone, high-density ceramics and the like.

The glass substrate 11 has a protruding portion 20*a* on which the heating resistive elements 12 are arranged. The protruding portion 20*a* is formed to have an approximately arc shape in vertical section at the center of the width direction as well as in the longitudinal direction (direction of an arrow L in FIG. 5) of the glass substrate 11. Accordingly, a surface facing the ink ribbon 3 (refer to FIG. 2) is the arc-shaped protruding portion 20*a*, and the heating resistive elements 12 arranged on the protruding portion 20*a* fit to the ink ribbon 3 suitably. As a result, thermal energy generated by the heating resistive elements 12 can be efficiently transmitted to the ink ribbon 3.

The heating resistive elements 12 generate thermal energy, which are arranged on the protruding portion 20*a* of the glass substrate 11 as described above. The heating resistive elements 12 are made of a material whose resistance value increases as the temperature increases (material whose temperature dependence of the resistance value has a positive characteristic) such as Ta (tantalum)-$SiO_2$ (silicon dioxide) or Nb (niobium)-$SiO_2$ (silicon dioxide). A portion in the heating resistive element 12 exposed between the power supply electrode 13*a* and the drive electrode 13*b* will be a heating portion 12*a* which actually generates thermal energy, which is arranged on the protruding portion 20*a* to be a rectangle having a length L1. The heating portion 12*a* is formed to be larger than a dot size of ink to be transferred for dispersing generated thermal energy.

The reason that the material whose temperature dependence of the resistant value has the positive characteristic is used as the heating resistive elements 12 is for suppressing abnormal temperature increase of the heating portions 12*a* by itself. Specifically, materials commonly used in the past are materials having no temperature dependence or less dependence. However, when the temperature dependence has the positive characteristic, for example, if the temperature increases in the empty heating portion (refer to FIG. 4), the resistance value also increases, therefore, electric current flowing in the heating resistive elements 12 is decreased. Accordingly, the heating value is also decreased and the temperature increase at the empty heating portion is suppressed by itself. As a result, permanent change of the resistive value caused by the temperature increase and breaking limit are improved, which improves durability and reliability.

At the beginning of power application to the heating resistive elements 12, since generated heat is absorbed in the periphery, it is difficult to realize rapid temperature increase, therefore, an image will be the one without sharpness. This status is the same when performing printing which requires rapid temperature change. However, in the case that the material whose temperature dependence of the resistive value has the positive characteristic is used, as the temperature increases by the start of power application, the resistive value of the heating resistive elements 12 also increases and large electric power is applied. As a result, the heating value increases as well as rising characteristics of temperature increase are improved.

The power supply electrode 13*a* and the drive electrodes 13*b* supply electric current from the power supply to the heating resistive elements 12 as well as drive the heating resistive elements 12 to heat the heating portions 12a. The power supply electrode 13*a* and the drive electrodes 13*b* are made of a material having good electric conductivity such as Al (Aluminum), Au (gold) or Cu (copper). As shown in FIG. 5, the power supply electrode 13*a* is a common electrode which is electrically connected to all heating resistive elements 12, and the drive electrode 13*b* is an individual electrode individually connected to each heating resistive element 12.

The power supply electrode 13*a* (common electrode) is provided at an opposite side to the side in which the flexible substrates for power supply 61 (refer to FIG. 3) are adhered, interposing the protruding portion 20*a* of the glass substrate 11. Both sides of end portions are led to the direction of the flexible substrates 61 along a short edge of the glass substrate 11, connected to the flexible substrates for power supply 61 electrically through the ACF (anisotropic conductive film). Therefore, the power supply electrode 13*a* is connected to the power supply through the flexible substrates for power supply 61 and electric current is supplied to all heating resistive elements 12.

Furthermore, the drive electrode 13*b* (individual electrode) is provided at the side in which the flexible substrates for driving 62 are adhered, interposing the protruding portion 20*a* of the glass substrate 11. The drive electrodes 13*b* are electrically connected to the flexible substrates for driving 62 connected to a control circuit controlling the drive of the heating resistive elements 12 through the ACF (anisotropic conductive film). Accordingly, electric current is supplied to selected heating resistive elements 12 by the control circuit for a certain period of time, thereby heating the heating portions 12*a* of the heating resistive elements 12, and ink of the ink ribbon 3 (refer to FIG. 2) is sublimed by the thermal energy to increase the temperature in which the ink is transferred on the printing paper 2 (refer to FIG. 2).

Further, the power supply electrode 13*a* and the drive electrodes 13*b* are connected to the flexible substrates for power supply 61 (refer to FIG. 3) and the flexible substrates for driving 62 (refer to FIG. 5) through the ACF (anisotropic conductive film) made of an insulating resin material, therefore, heat generated at the heating portions 12*a* is prevented from being released in the directions of the flexible substrates for power supply 61 and the flexible substrates for driving 62 through the power supply electrode 13*a* and the drive electrode 13*b*. Therefore, useless heat release of heat generated from the heating portions 12*a* is suppressed and thermal efficiency is improved.

The heat conductive layer 70 is provided on the heating resistive elements 12 (heating portions 12*a*), the power supply electrode 13*a* and the drive electrodes 13*b*. As shown in FIG. 6, the heat conductive layer 70 is provided so as to touch the heating resistive elements 12 (heating portions 12*a*), the power supply electrode 13*a* and the drive electrodes 13*b*, including an electric insulating layer 71 which secures electrical insulation property with respect to these electrodes and the like, and a heat diffusion layer 72 which is stacked on the electric insulating layer 71 and diffuses heat generated from the heating portions 12*a*.

The protective film 30 is provided at the most outside of the heat portion 10a. The protective film 30 protects the heating portions 12*a* and the like from the friction and the like when the head portion 10*a* abuts on the ink ribbon 3 (refer to FIG. 2) by covering the heat conductive layer 70. Materials including sliding property and abrasion resistance are used for the protective film 30, for example, SiAlON is preferable, which has high strength under high temperature and is excellent in abrasion resistance, heat resistance, thermal shock resistance and thermal conductivity. As the materials, for example, engineering ceramics represented by a chemical formula of SiAlON is preferable, which includes four elements of Si (silicon), Al (aluminum), O (oxygen) and N (nitrogen), in which an Al (aluminum) atomic element substitutes for a part of a Si (silicon) atomic element and an O (oxygen) atomic element substitutes for a part of a N (nitrogen) atomic element.

As described above, the head portion 10*a* includes the glass substrate 11 in which the protruding portion 20*a* and the gap portion 11*a* having the width W1 facing the protruding portion 20*a* are formed, the heating resistive elements 12 in which heating portions 12*a* having the length L are provided on the protruding portion 20*a*, the power supply electrode 13*a* and the drive electrodes 13*b* for heating the heating resistive elements 12, the heat conductive layer 70 including the electric insulating layer 71 and the heat diffusion layer 72 and the protective film 30 provided at the most outside. Then, the heatsink 40 is adhered to the head portion 10*a* to form the thermal head 10.

The heatsink 40 is made of metal such as AL (aluminum), which is adhered to the back of the glass substrate 11 so as to close an opening surface of the gap portion 11*a*. The adhesion of the glass substrate 11 and the heatsink 40 is performed by coating the adhesive 50 (refer to FIG. 6) at the surface of the heatsink 40 and by adding heat while pressing the glass substrate 11 from the above. The adhesive 50 is made of materials having elasticity and thermal conductivity (for example, a heat-curing silicon rubber and the like), which includes a filler having high degree of hardness and thermal conductivity (for example, granular or linear $Al_2O_3$ (aluminum oxide) and the like).

Accordingly, the adhesive 50 (refer to FIG. 6) has thermal conductivity, thereby releasing excess heat in the glass substrate 11 side efficiently to the heatsink 40 when power application with respect to the heating resistive elements 12 is stopped (when the printing is not performed). The shear force due to the difference of thermal expansion coefficient between the glass substrate 11 and the heatsink 40 is absorbed by the thickness of the adhesive 50 (for example, approximately 50 μm), therefore, the heatsink 40 is not peeled.

In the thermal head 10 according to the first embodiment, the protruding portion 20*a* of the glass substrate 11 is exposed to high temperature due to thermal energy generated from the heating portions 12*a* of the heating resistive elements 12. Also, in the empty heating portion (refer to FIG. 4), the temperature of the protruding portion 20*a* is locally increased. When such high-temperature states continues, permanent change may occur in the resistance value of the heat resistive elements 12, and the glass substrate 11 (protruding portion 20*a*) or the heating resistive elements 12 (heating portions 12*a*) may be destroyed, which will damage the durability and reliability of the thermal head 10.

However, the thermal head 10 according to the first embodiment is provided with the heat conductive layer 70 so as to touch the heating portions 12*a* of the heating resistive elements 12. The heat conductive layer 70 includes the heat diffusion layer 72 which diffuses heat generated from the heat resistive elements 12 (heating portions 12*a*). The heat diffusion layer 72 is made of a metal film having high thermal conductivity such as Al (aluminum), Au (gold), Cu (copper) and the like, and the necessary thermal conductivity is adjusted by the thickness of the heat conductive layer 70. Accordingly, heat distribution concentrated on the heating portions 12*a* is diffused by the heat diffusion layer 72 (diffused in the direction parallel to the heat diffusion layer 72), which reduces extreme temperature increase of the heating portions 12*a*.

The heat conductive layer 70 also includes the electric insulating layer 71 for electric insulation with respect to the heating resistive elements 12 (heating portions 12*a*), the power supply electrode 13*a*, the drive electrodes 13*b* and the heat diffusion layer 72 (metal film) and for preventing oxidation of the heating resistive elements 12 (heating portions 12*a*) and the like. The electric insulating layer 71 is preferably made of, for example, SiAlON (sialon) in the same manner as the protective film 30. The heat conductive layer 70 is provided above the heating resistive elements 12 (heating portions 12*a*), in which the electric insulating layer 71 is formed as the lower layer and the heat diffusion layer 72 is formed as the upper layer.

As described above, in the thermal head 10 according to the first embodiment, the electric insulation with respect to the heating resistive elements 12 (heating portions 12*a*), the power supply electrode 13*a* and the drive electrodes 13*b* is secured by the electric insulating layer 71 of the heat conductive layer 70 as well as heat generated from the heating resistive elements 12 (heating portions 12*a*) is diffused by the heat diffusion layer 72.

In the glass substrate 11 of the thermal head 10, the gap portion 11*a* is formed so as to face the protruding portion 20*a*. That is, the gap portion 11*a* faces the protruding portion 20*a* on which the heat resistive elements 12 are arranged in the longitudinal direction (direction of an arrow L in FIG. 5) of the thermal head 10, which is formed to be a concave shape toward the heating portions 12*a* of the heating resistive elements 12. Accordingly, air in the gap portion 11*a* suppresses heat release to the glass substrate 11 efficiently due to characteristics of air whose thermal conductivity is lower than glass, and it becomes difficult to release thermal energy generated from the heating portions 12*a* to the glass substrate 11. As a result, thermal energy in the direction of the ink ribbon 3 (refer to FIG. 2) can be increased to thereby improve thermal efficiency of the thermal head 10.

Furthermore, the thickness of the protruding portion 20*a* is thin due to the gap portion 11*a*, therefore, the heat accumulation amount is small. Accordingly, since thermal energy can be released in a short period of time, the temperature of the thermal head 10 can be immediately decreased when the heating portions 12*a* are not heated. As a result, response of the thermal head 10 is improved and high quality images or characters can be printed while saving power at high speed without generating disadvantages such as blur of images or characters.

Additionally, the protruding portion 20*a* will be the heat accumulation portion of thermal energy generated from the heating portions 12*a*. Owing to thermal energy accumulated in the protruding portion 20*a*, it is possible to immediately increase the temperature to a sublimation temperature of ink while saving power when the ink is transferred on the printing paper 2 (refer to FIG. 2). As a result, thermal efficiency of the thermal head 10 is further improved.

Figure 9:
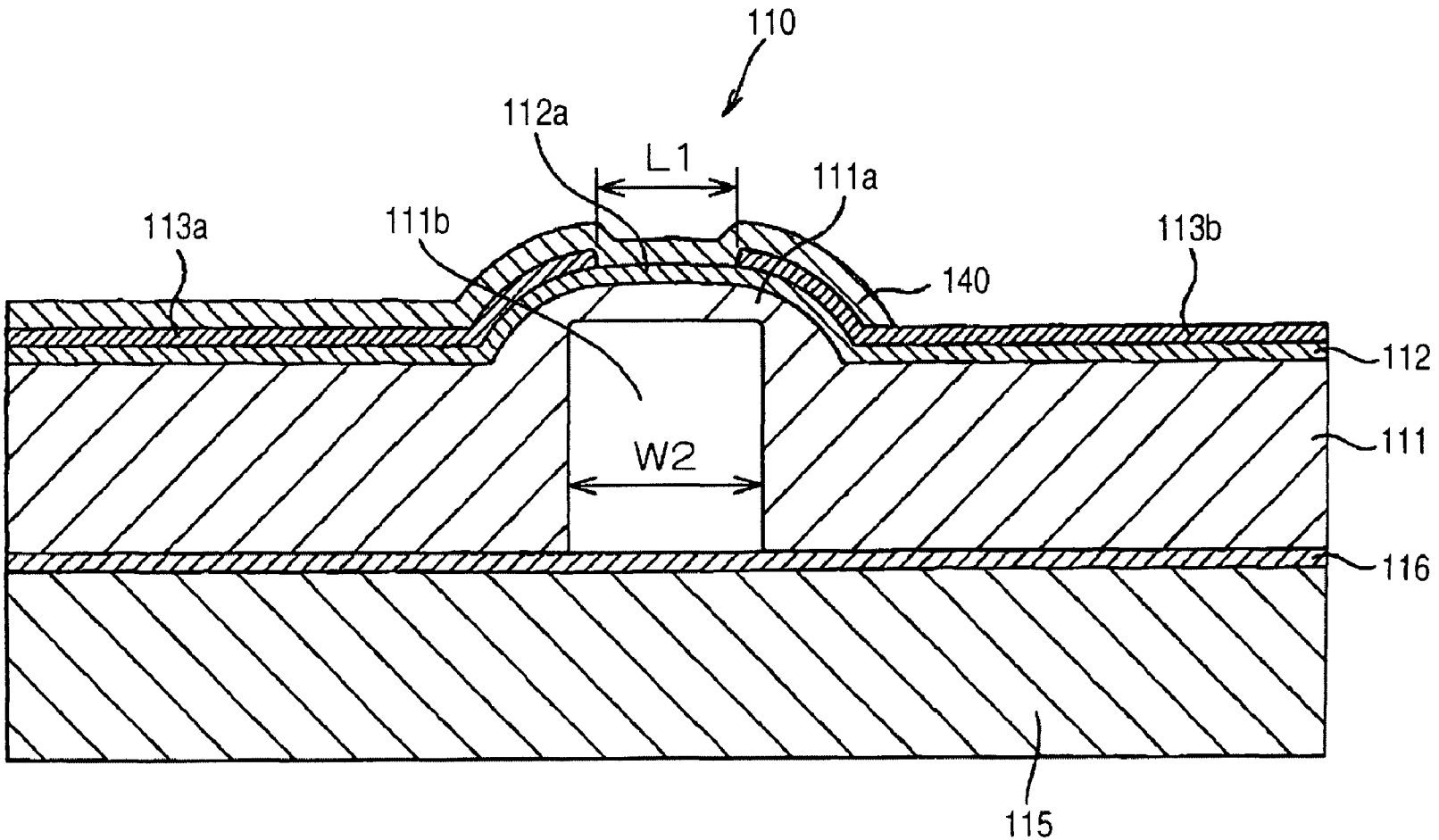
FIG. 9 (PRIOR ART)
FIG. 9 is a longitudinal sectional view showing a thermal head in related art.

Here, the width W1 of the gap portion 11*a* is formed to be smaller than the length L1 of the heating portion 12*a* (gap portion width W1<heating portion length L1). This is for reducing local temperature increase at the empty heating portion (refer to FIG. 4). That is, when the gap portion width W2>heating portion length L1 as in the thermal head 110 of related art shown in FIG. 9, the amount of air in the gap portion 111*b* increases and the heat release to the glass substrate 111 is drastically suppressed. However, the temperature of the protruding portion 111*a* increases locally at the empty heating portion due to the suppression of heat release to the glass substrate 111.

Considering the above, in the thermal head 10 according to the first embodiment, the heat release to the glass substrate 11 is allowed to some extent, thereby suppressing the local temperature increase of the protruding portion 20*a* at the empty heating portion (refer to FIG. 4). The temperature at the empty heating portion can be adjusted to be a desired temperature by adjusting the width W1 of the gap portion 11*a* with respect to the length L1 of the heating portion 12*a* in the range of the gap portion width W1<the heating portion length L1. Accordingly, it is possible to improve the durability and reliability of the thermal head 10 (heat resistance and breaking strength of the protruding portion 20*a*) by a synergistic effect of the adjustment and the heat conductive layer 70 (heat diffusion layer 72).

Figure 7:
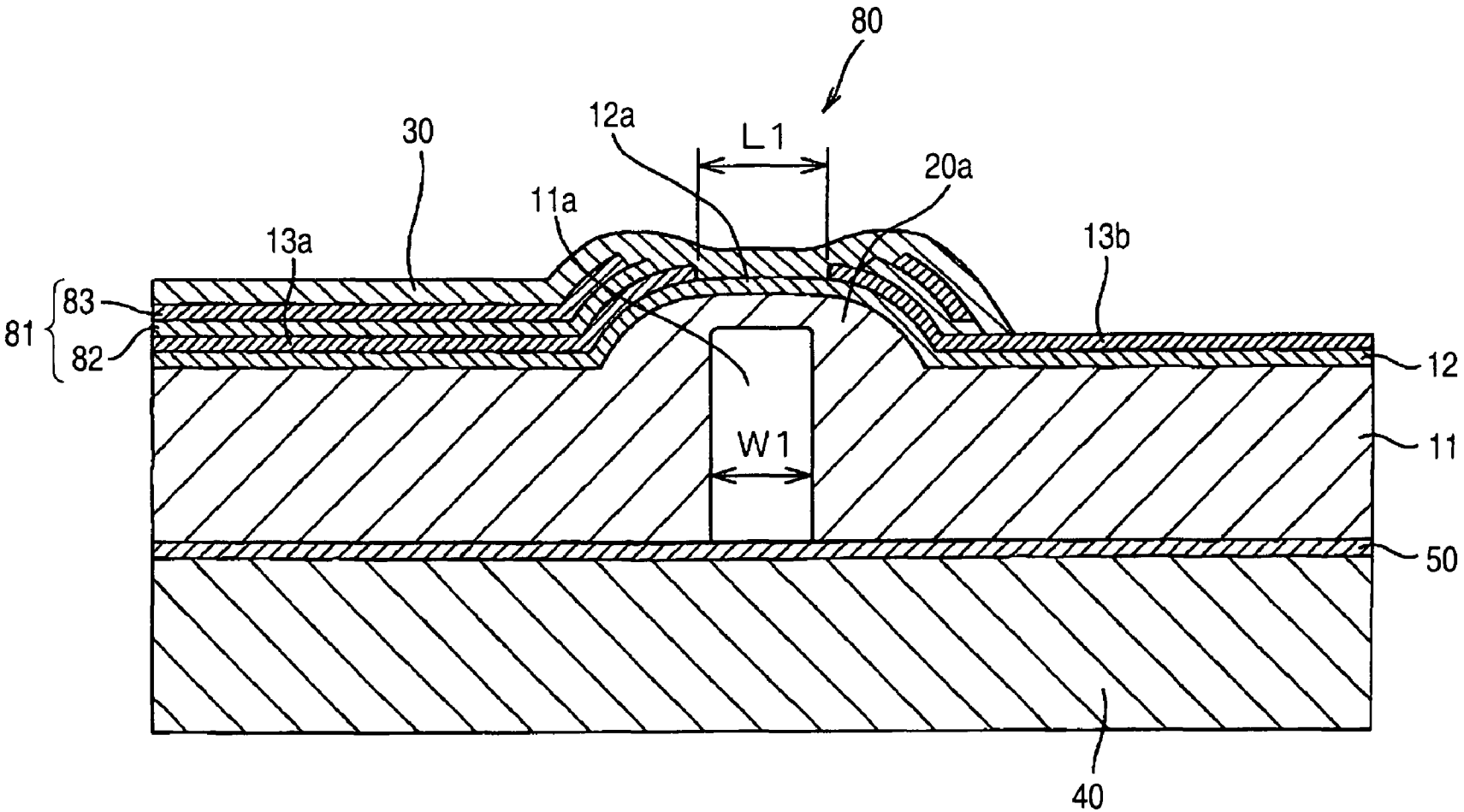
FIG. 7 is a longitudinal sectional view showing a thermal head according to a second embodiment.

FIG. 7 is a longitudinal sectional view showing a thermal head 80 according to a second embodiment.

As shown in FIG. 7, the thermal head 80 according to the second embodiment secures electric insulation with respect to the power supply electrode 13*a* and the drive electrodes 13*b* by an electric insulating layer 82 of a heat conductive layer 81 as well as diffuses heat generated from the heating resistive elements 12 (heating portions 12*a*) by a heat diffusion layer 83 in the same manner as the thermal head 10 according to the first embodiment. The width W1 of the gap portion 11*a* is formed to be smaller than the length L1 of the heating portion 12*a* (gap portion width W1<heating portion length L1), thereby reducing local temperature increase of the empty heating portion (refer to FIG. 4).

On the other hand, the thermal head 80 according to the second embodiment is different from the thermal head 10 according to the first embodiment in a point that the heat conductive layer 81 (the electric insulating layer 82 and the heat diffusion layer 83) is not provided at the heating portions 12*a* of the heating resistive elements 12. This is for suppressing heat diffusion in the vicinity of the heating portions 12*a* which contributes best to printing. That is, the heat conductive layer 81 is not provided in the vicinity of the heating portions 12*a*, thereby preventing reduction of printing quality due to the spread of heat distribution at a portion affecting the printing. It is possible to adjust the heat diffusion effect and the printing quality by changing the range of cutting the heat conductive layer 81.

Figure 8:
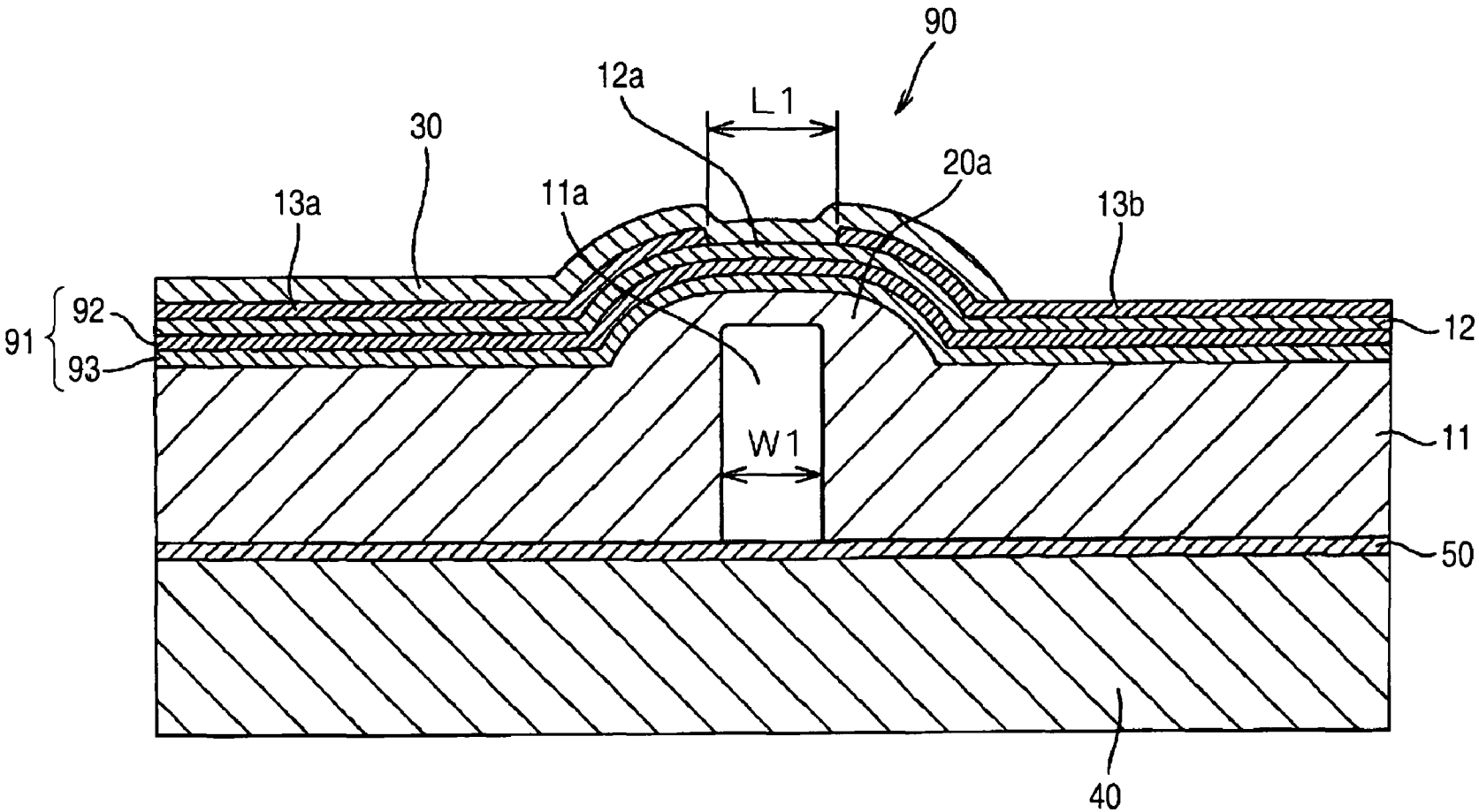
FIG. 8 is a longitudinal sectional view showing a thermal head according to a third embodiment.

FIG. 8 is a longitudinal sectional view showing a thermal head 90 according to a third embodiment.

As shown in FIG. 8, the thermal head 90 according to the third embodiment secures electric insulation with respect to the heating resistive elements 12 (heating portions 12*a*) by an electric insulating layer 92 of a heat conductive layer 91 as well as diffuses heat generated from the heating resistive elements 12 (heating portions 12*a*) by a heat diffusion layer 93 in the same manner as the thermal head 10 according to the first embodiment. The width W1 of the gap portion 11*a* is formed to be smaller than the length L1 of the heating portion 12*a* (gap portion width W1<heating portion length L1), thereby reducing local temperature increase of the empty heating portion (refer to FIG. 4).

On the other hand, the thermal head 90 according to the third embodiment is different from the thermal head 10 according to the first embodiment in a point that the heat conductive layer 91 is provided under the heat resistive elements 12 (heating portions 12*a*), in which the electric insulating layer 92 is formed as the upper layer and the heat diffusion layer 93 is formed as the lower layer. This is for ensuring the electric insulation of the heat diffusion layer 93 by the electric insulating layer 92. That is, the heat conductive layer 91 is arranged under the heating resistive elements 12 (heating portions 12*a*), thereby depositing the electric insulating layer 92 on the protruding portion 20*a* where there is not level difference in the vicinity of the heating portions 12*a* (level difference at ends of the power supply electrode 13*a* and the drive electrodes 13*b*), as a result, the electric insulating layer 92 can be formed between the heating resistive elements 12 and the heat diffusion layer 93 without defects such as film deposition failures. Accordingly, insulation failures of the heat diffusion layer 93 can be positively avoided.

As described above, the thermal head 10, the thermal head 80 and the thermal head 90 according to respective embodiments include the heat conductive layer 70 (the heat conductive layer 81, the heat conductive layer 91). Accordingly, the heat distribution concentrated on the heating portions 12*a* is diffused and extreme temperature increase at the heating portions 12*a* is reduced, therefore, the durability and reliability of the heating portions 12*a* and the heat resistance and breaking strength of the protruding portion 20*a* are improved. As a result, it is possible to print high quality images or characters at high speed while saving power consumption with good thermal efficiency and response.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal head, comprising:

a head body portion including a flat portion and a protruding portion forming a dome-shaped structure integrally formed with and projecting from the flat portion, as viewed in cross-section, and a hollow concave gap portion formed into the flat portion and extending from the flat portion partially into the protruding portion, the protruding portion having a power-side arc segment, a drive side arc segment spaced-apart from and disposed opposite the power-side arc segment and a generally flat top segment interconnecting the drive-side arc segment and the power side arc segment, the protruding portion positioned on the head body portion to divide the head body portion into a power supply side head body portion and a drive side head body portion;

a heating element layer disposed on and extending across the power supply side head body portion, the protruding portion and the drive side head body portion, the heating element layer having a heating portion arranged at and on the top segment of the protruding portion;

a power supply electrode layer disposed on the power supply side head body portion and extending onto the power side arc segment and terminating in a power supply electrode layer terminal end at the heating portion;

a drive electrode layer disposed on the drive side head body portion and extending onto the drive side head body portion and the drive side arc segment and terminating in a drive electrode layer terminal end at the heating portion;

an electric insulating layer disposed on the drive electrode layer and terminating in an electric insulating layer terminal end positioned adjacent to yet short of the power supply electrode layer terminal end; and a heat diffusion layer disposed on the electric insulating layer and terminating in a heat diffusion layer terminal end positioned adjacent to yet short of the electric insulating layer terminal end, wherein a width W1 of the concave gap portion is smaller than a length L1 of the heating portion of the heating element and wherein the heat diffusion layer terminal end, the electric insulating layer terminal end and the drive electrode layer terminal end forming, in part, a stepped-down opening to the heating portion.

2. A thermal printer, comprising:

a thermal head, including a head body portion a flat portion and a protruding portion forming a dome-shaped structure integrally formed with and projecting from the flat portion, as viewed in cross-section , and a hollow concave gap portion formed into the flat portion and extending from the flat portion partially into the protruding portion, the protruding portion having a power-side arc segment, a drive side arc segment spaced-apart from and disposed opposite the power-side arc segment and a generally flat top segment interconnecting the drive-side arc segment and the power side arc segment, the protruding portion positioned on the head body portion to divide the head body portion into a power supply side head body portion and a drive side head body portion;

a heating element layer disposed on and extending across the power supply side head body portion, the protruding portion and the drive side head body portion, the heating element layer having a heating portion arranged at and on the top segment of the protruding portion;

a power supply electrode layer disposed on the power supply side head body portion and extending onto the power side arc segment and terminating in a power supply electrode layer terminal end at the heating portion;

a drive electrode layer disposed on the drive side head body portion and extending onto the drive side head body portion and the drive side arc segment and terminating in a drive electrode layer terminal end at the heating portion;

an electric insulating layer disposed on the drive electrode layer and terminating in an electric insulating layer terminal end positioned adjacent to yet short of the power supply electrode layer terminal end; and a heat diffusion layer disposed on the electric insulating layer and terminating in a heat diffusion layer terminal end positioned adjacent to yet short of the electric insulating layer terminal end, wherein a width W1 of the concave gap portion is smaller than a length L1 of the heating portion of the heating element and wherein the heat diffusion layer terminal end, the electric insulating layer terminal end and the drive electrode layer terminal end forming, in part, a stepped-down opening to the heating portion.

* * * * *